United States Patent [19]

Veiniere

[11] 4,168,786

[45] Sep. 25, 1979

[54] APPARATUS FOR DISPENSING ARTICLES HAVING A SLIDABLE COVER ENGAGING A SLIDABLE PUSHING MEMBER

[75] Inventor: Jean-Pierre Veiniere, Dyohmax, France

[73] Assignee: American Home Products Corporation, New York, N.Y.

[21] Appl. No.: 861,918

[22] Filed: Dec. 19, 1977

Related U.S. Application Data

[63] Continuation of Ser. No. 674,757, Apr. 8, 1976, abandoned.

[30] Foreign Application Priority Data

Apr. 14, 1975 [FR] France ..... 75 12045

[51] Int. Cl.[2] ..... B65D 83/04

[52] U.S. Cl. ..... 221/251; 221/267

[58] Field of Search ..... 221/198, 246, 251, 267, 221/249, 229, 279, 280, 307, 232

[56] References Cited

U.S. PATENT DOCUMENTS

| | | | |
|---|---|---|---|
| 1,003,911 | 9/1911 | Johnston | 221/267 |
| 2,063,556 | 12/1936 | O'Brien | 221/246 |
| 2,645,336 | 7/1953 | Waber et al. | 221/246 |
| 2,877,927 | 3/1959 | King | 221/246 |
| 3,040,929 | 6/1962 | Tapper | 221/246 |
| 3,612,348 | 10/1971 | Thomas | 221/198 X |

*Primary Examiner*—Robert J. Spar
*Assistant Examiner*—Fred A. Silverberg
*Attorney, Agent, or Firm*—Joseph Martin Weigman

[57] ABSTRACT

An apparatus for individually dispensing a plurality of articles is provided comprising:

(a) a case for receiving articles to be dispensed;

(b) a cover slidably mounted on the case for reciprocal movement relative thereto wherein movement of the cover in the direction of dispensing an article forms an opening for removal of a single article;

(c) a pushing member slidably positioned between the case and cover and cooperating with movement of the cover to advance articles to be dispensed, the pushing member flexibly engaging the case and the cover in a retainer located on the inner surface of the case and cover, the pushing member being advanced in the direction of dispensing an article at a distance equal to the displacement of an article in response to movement of the cover in that direction and immovable in response to movement of the cover in the direction opposite to dispensing an article.

3 Claims, 8 Drawing Figures

APPARATUS FOR DISPENSING ARTICLES HAVING A SLIDABLE COVER ENGAGING A SLIDABLE PUSHING MEMBER

This is a continuation of application Ser. No. 674,757, filed Apr. 8, 1976 now abandoned.

BACKGROUND OF THE INVENTION

This invention is concerned with an apparatus for individually dispensing a plurality of articles having means for storing and guiding the articles in the direction of an orifice for removal one-at-a-time.

In the past many devices for distributing articles have been described having means of feeding the articles and of selecting a single article to be dispensed which vary according to the nature and dimensions of the article.

For example in U.S. Pat. No. 3,040,929 which issued on June 26, 1962, an apparatus described for dispensing tablets, one-at-a-time, while the remaining tablets continue to be securely held in the apparatus. The dispenser comprises a container for the tablets which container has a row of teeth along each of its side walls. A cover and ram fit slidably over the container, the cover containing a "saw tooth" spine along the length of its central portion and the ram fitting over the rearward end of the spine so that when the cover is placed in position on the container, the ram will be in back of the tablets. The ram also contains a fixed pair of flexible pawls which prevent backward movement by engaging successive teeth of the "saw tooth" spine. When the cover is drawn back, one tablet is exposed at one end of the container and can be dropped out of the container by inverting it. At the same time, the upwardly directed pawl of the ram will engage the next forward tooth of the spine so that when the cover is moved forward to the closed position, the ram will move forward, thereby moving all of the remaining tablets forward.

In U.S. Pat. No. 3,612,348 which issued on Oct. 12, 1971, a pill dispenser having a disposable magazine for one-at-a-time dispensing of pills is provided. The dispenser comprises a container in the form of a hollow cylindrical member open at one end and having an exit opening adjacent a closed end. An elongated bore within the container terminating at the exit opening in an elongated position is adapted to accept a disposable package. The disposable package is designed to support a plurality of pills within the container in order that the pills can be forced from the package and be removed from the exit opening. Depression of an actuator button acts to both move the pill support to its lower position thereby enabling the bottommost pill to be removed through an opening and to move the plunger downward against the pills. A spring member acts to return the pill support to its upper position. A finger on the plunger engages rachet teeth on the container to maintain the plunger fixed relative to the hollow member and disposable package when the button is moved in the upward direction by the spring.

The present invention provides a distributing device of simple construction and simple operation suitable for the direct unitary distribution of articles, particularly articles of small dimensions and of light weight such as test tubes made of plastic material, pharmaceutical products in the form of capsules, tablets or tablets packaged in plastic material, or edible products packaged in small plastic wrappers as for example confectioneries, sticks of chocolate, sweets, chewing-gum, etc.

SUMMARY OF THE INVENTION

The apparatus of this invention comprises:

(a) a case for receiving articles to be dispensed;

(b) a cover slidably mounted on said case for reciprocal movement relative thereto wherein movement of said cover in the direction of dispensing an article forms an opening for removal of a single article;

(c) a pushing member slidably positioned between said case and cover and cooperating with movement of said cover to advance articles to be dispensed, said member having means for flexibly engaging said case and said cover in retaining means located on the inner surface of said case and cover, said member being advanced in the direction of dispensing an article at a distance equal to the displacement of an article in response to movement of said cover in said direction and immovable in response to movement of said cover in the direction opposite to dispensing an article.

According to the invention, the means of feeding, guiding and of selecting the article to be dispensed includes a cover slidably mounted on a case which houses the articles, so as to be capable of reciprocal movement with respect to said case, the cover cooperating with a pushing member applying itself against the articles or products so as to permit a displacement of the member in a single direction thereby feeding the articles or products in front of it in the direction of the opening for removal formed by displacement of the cover.

In a particularly advantageous embodiment of the invention the pushing member is slidably mounted on grooves on the case and the cover so as to be able to displace itself length-wise between the case and the cover, and contains means for taking up support elastically against the inner surfaces of the case and cover and engaging retaining means such as notches placed lengthwise on the interior surfaces of the case and cover. The notches are spaced a distance corresponding to the displacement of a single article or product.

Preferably, the flexibly engaging means on the pushing component is a U-shaped pawl or catch formed by a blade or flexible element fastened to the pushing component so that the free ends of the blade or flexible element take up support elastically against the inner surfaces of the case and the cover and engage themselves elastically in the notches.

In another advantageous form of the dispenser according to the invention the catch or pawl can also be an integral part of the pushing component, when the latter is made of plastic material sufficiently resilient so that the catches can cooperate elastically with the interior surfaces of the case, cover and the notches.

Generally, two lengthwise rows of notches are located on each of the inner surfaces of the case and cover, respectively, with the rows being arranged adjacent to the side partitions of the case and cover. The pushing component then contains two catches or pawls engaging the notches of the rows.

The dispensing apparatus according to the invention can further contain means of abutment which limit the reciprocal movement of the cover on the case, in such a way that the course of the cover corresponds appreciably to the width or displacement of a single article or product.

The invention will be further described with reference to the drawings.

DETAILED DESCRIPTION OF THE PREFERRED EMBODIMENT

Figure 1:
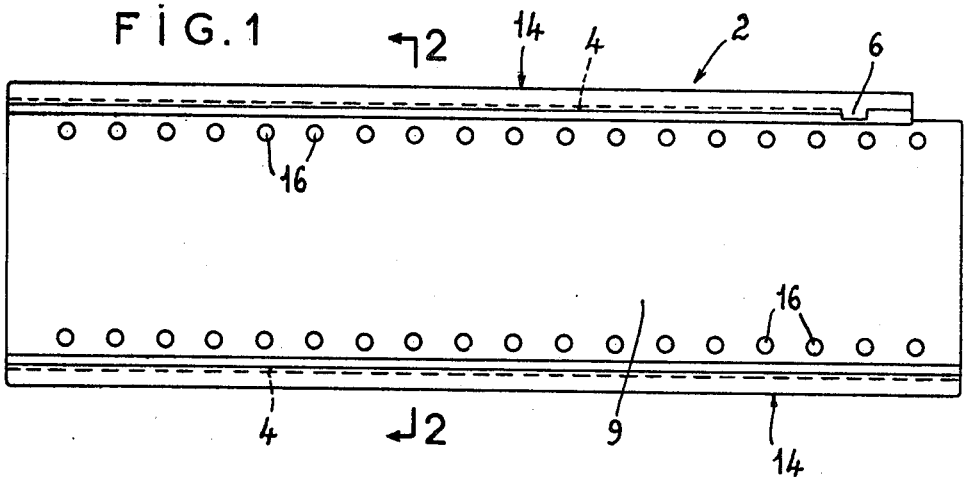
FIG. 1 is a plan view of the case of the dispenser.
Figure 3:
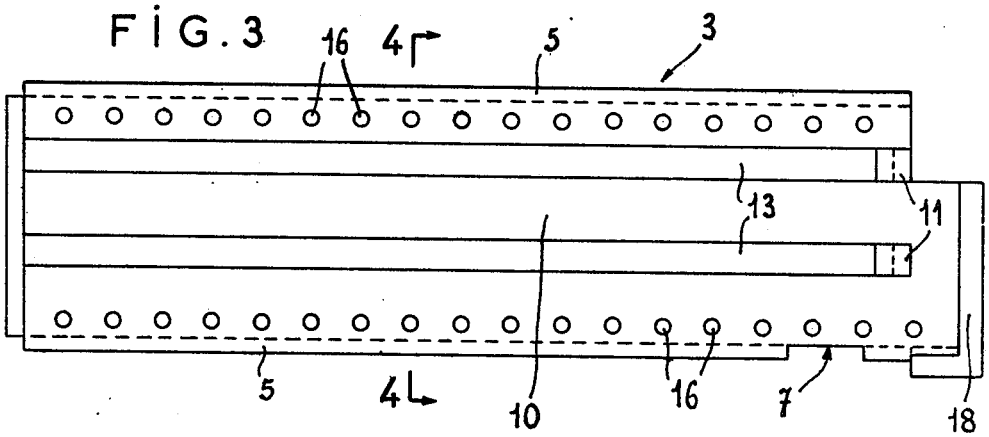
FIG. 3 is a bottom view of the cover of the dispenser.
Figure 2:
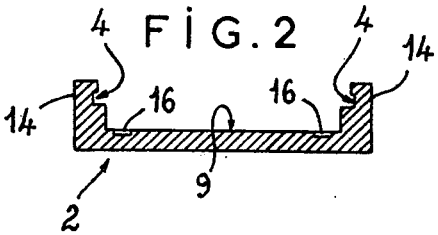
FIG. 2 is a vertical section view of the case taken along the line 2—2 of FIG. 1.
Figure 4:
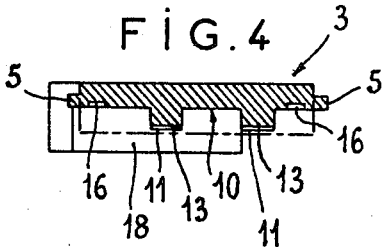
FIG. 4 is a vertical section view taken along the line 4—4 of FIG. 3.
Figure 5:
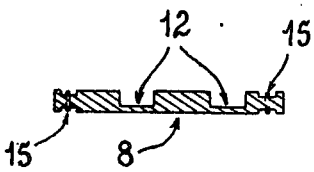
FIG. 5 is a vertical section view of the pushing component.

Referring to FIGS. 1 to 5, the dispensing device comprises a case designated by 2, preferably made of plastic material such as polystyrene or any other plastic material. On the case a cover 3, preferably also made of polystyrene and strengthened with lengthwise reinforcements or ribs 13, is mounted to slide along grooves 4 on the case.

The reciprocal movement of the cover on the case is limited in its course by an abutment 6 on one of the lateral sides 14 of the case, which slidably engages longitudinal recess 7 on the edge of the cover. Recess 7 limits the movement of the cover in the direction of dispensing an article.

Figure 6:
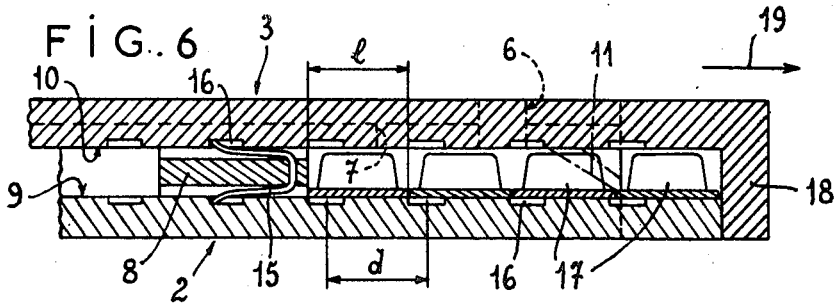
FIGS. 6 and 7 are fragmentary vertical section views taken adjacent an end portion of the dispenser which is loaded with articles.
Figure 7:
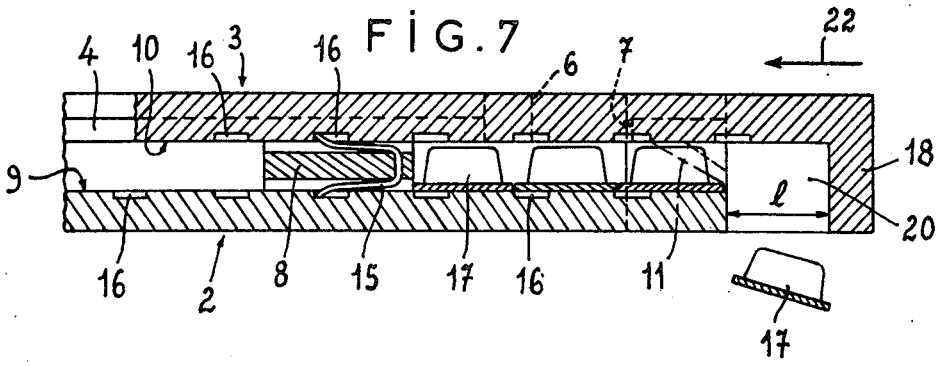
Figure 8:
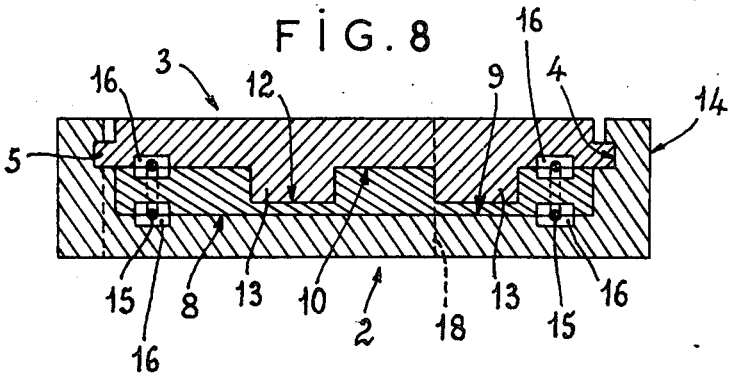
FIG. 8 is a transverse vertical section view of the dispenser.

On the interior surface 9 of the case, a pushing member 8 (FIG. 5) is slidably mounted lengthwise between the case and the interior flat surface 10 of the cover through two longitudinal guiding grooves 12 which engage the two longitudinal reinforcement ribs 13 on the cover. The pushing member extends transversely to a width corresponding approximately to the width of the side walls 14 of the case. The pushing member further contains, in proximity to its ends, a catch or pawl formed by a blade or flexible element 16, preferably metallic, fitted in the pushing member and curved in the shape of "U" as shown in FIGS. 6 and 7. The free ends of this blade or element 15 elastically engage the inner surfaces 9 and 10, respectively, of the case and cover and dispose themselves in the notches 16 positioned lengthwise adjacent to the edges of these surfaces. Two longitudinal rows of notches are located on each of the inner surfaces of the case and cover. These rows are arranged adjacent to the side walls of the case and of the longitudinal edges of the cover. Each of these rows include the same number of notches 16 spaced apart by fixed intervals between them or, more exactly, between their respective axes, by a distance "d" substantially corresponding to the displacement of an article 17 to be dispensed to the width "e" occupied by an article (FIG. 6). The notches 16 on the cover are arranged to be aligned with a row of the same notches on the case and to be placed one above the other when the cover is mounted on the case.

The cover 3 contains an extended edge 18 at its forward extremity. This edge takes up support against the extreme end of the case (as represented in FIG. 6) when the dispenser is in the closed position. When in the opened position, that is, when the cover is moved in the direction of the arrow 19, an opening 20 is formed for dispensing an article 17 as shown in FIG. 7. The width of this opening for dispensing corresponds to the travel of the cover which is about equal to the width "e" of an article 17 in order to permit its easy removal.

In operating the dispenser the apparatus is first completely loaded with articles or objects 17 placed side-by-side on the inner surface of the case with the pushing member 8 being at the retracted one extremity of the apparatus behind the articles as shown in FIG. 6.

When the cover 3 is manually displaced in the direction of the arrow 19 in FIG. 6 to the position where the cover meets the lateral abutment 6, the pushing member 8 is advanced towards the advanced extremity of the apparatus (the direction of dispensing) to advance the group of objects 17 by a distance "e". The cover 3 then is in the position shown in FIG. 7 in which the article or object 17 at the end of the group drops down the opening 20 for removal in response to the movement of the cover. The displacement of the pushing member is brought about by the U-shaped catches or pawls 15 which engage the notches 16 of the cover and are then carried along by the latter. Because the two ends of each catch 15 are engaged elastically in the recesses or notches 16 of the cover and of the case, the pushing member remains motionless when the cover 3 is displaced in the direction of the arrow 22 (FIG. 7). The same steps of push and of ejection of an article or object 17 occur again when the cover is displaced in the direction of the arrow 19 and so forth until the pushing component reaches the forward end of the dispenser and ejects the last object.

In order to prevent a second article 17 from being dispensed or escaping through the opening 20 for removal when the dispenser is inclined in the direction of this opening, two blocking elements 11 (FIGS. 3 and 7) are angularly positioned on the cover by the extension of the reinforcements or ribs 13 on the cover in the direction of dispensing. These blocking elements can be of the same material as the reinforcements or ribs 13 or can be formed by blades of flexible elements attached to the end of these reinforcements.

Due to its simple reciprocating motion of the cover on the case, the dispenser of the invention provides unitary extraction of objects or products of any kind and any dimension. In the drawings, these objects 17 can be small test tubes of plastic material, arranged two-by-two in width on a support also made of plastic material; however, the apparatus can also be used for the distribution of many other objects of small size and light weight such as pharmaceutical products in the form of capsules, tablets, or tablets packaged in plastic material, edible products such as confectioneries, bonbons, chewing-gum, chocolates, and the like.

In another embodiment of the invention (not shown in the drawings), the catches or pawls 15 instead of being formed by blades of flexible elements, are made integral with the pushing member 8. In this arrangement the entire pushing member is made of flexible plastic material in order to permit the catches to flexibly engage the notches in the case and cover.

According to another embodiment (also not shown in the drawings), a spring may be incorporated in the rear of the dispenser to retract the cover to the position shown in FIG. 6. As a result whenever an article is dispensed, the spring is compressed by advancing the cover to the position shown in FIG. 7 and after the article is dispensed, the return of the cover to the position of FIG. 6 is accomplished by the tension of the spring.

What is claimed is:

1. In an apparatus for individually dispensing articles comprising an elongated case, and elongated cover slidably mounted on said case for reciprocal movement along the longitudinal axis thereof and in one position forming with said case an opening for dispensing articles adjacent one end of said cover, a pushing member slidably positioned between said case and said cover for movement along the longitudinal axis of the case to advance the article to be dispensed, said pushing member having a pawl on one side to engage the cover and a pawl on the opposite side to engage the case, and said pushing member being slidably mounted between the interior surface of the case and ribs located on the cover, the improvement comprising at least one flexible blocking element connected to said cover, adjacent the end forming one side of said opening, said blocking member extending towards said case, whereby dispensing is prevented of articles other than the article at said opening.

2. The device as defined in claim 1 further comprising oppositely facing notches in each of said case and said cover adapted to engage said pawls.

3. The device as defined in claim 2 wherein one pawl is adjacent to said case and the other pawl is adjacent to said cover and the oppositely faced notches are engaged by said pawls.

* * * * *